United States Patent [19]

Fisher

[11] 3,939,725

[45] Feb. 24, 1976

[54] REMOTE SWITCH ACTUATING DEVICE

[75] Inventor: William J. Fisher, Lisle, Ill.

[73] Assignee: Maynard Braverman, Chicago, Ill. ; a part interest

[22] Filed: Oct. 25, 1973

[21] Appl. No.: 409,479

[52] U.S. Cl. ..... 74/503; 200/331
[51] Int. Cl.[2] ..... G05G 1/00
[58] Field of Search ..... 74/503, 501; 200/331

[56] References Cited

UNITED STATES PATENTS

| | | | |
|---|---|---|---|
| 2,668,456 | 2/1954 | Meistrell | 200/331 |
| 3,190,084 | 6/1965 | Moon et al. | 74/501 |
| 3,390,589 | 7/1963 | Tschanz | 74/501 |
| 3,564,186 | 2/1971 | Mittelstadt | 200/331 |

*Primary Examiner*—Samuel Scott
*Assistant Examiner*—Wesley S. Ratliff, Jr.
*Attorney, Agent, or Firm*—Mann, Brown & McWilliams

[57] ABSTRACT

A remote switch actuating device to permit the operator to actuate an electrical switch that is located remotely from the operator's position, comprising a rocker arm type electrical switch that is mounted within easy reach of the operator in the usual electrical box, which, however, is free of electrical connections, but is mechanically connected by a drive rod to an actuator assembly which mounts the remote power switch to be actuated in an appropriate electrical box that is remotely located for safety and other purposes. The actuator assembly includes a swing arm formed to receive the rocker arm of the switch to be actuated. The drive rod is masked and guided within electrical conduiting that connects the two boxes.

4 Claims, 10 Drawing Figures

REMOTE SWITCH ACTUATING DEVICE

This invention relates to a device for actuating a remotely located electrical switch, aand more particularly, to an electrical switch actuation device of an entirely mechanical character that may be located for convenience of hand operation by the operator to actuate a remotely located electrical switch.

Electrical codes frequently require that electrical control switches that are to be operated by the public be limited in voltage to a specified maximum. Since many control switches involve operation under substantially higher voltages, it has become common practice to provide an actuator switch that is located within easy reach of the operator, which is electrically connected to relays and associated equipment, and the like, that operate, on operation of the actuator switch, to open and close the high voltage control switch. Such arrangements involve expensive electrical equipment and wiring and labor to install same, just to effect operation of the power switch, and, of course, since the box for the actuator switch is wired appropriately, the operator still must handle equipment that houses electrically charged wire connections, even though approved voltage levels may be involved.

A principal object of the present invention is to provide a device for actuating remotely located power switches that is entirely mechanical in nature and free of electrical connections except to the electrical power switch that is to be operated.

Another important object of the invention is to provide a device for actuating remotely located switches which utilizes a number of standard electrical components without requiring, however, electrical connections, except to the power switch that is being controlled.

Other objects of the invention are to provide a device for actuating remotely located power switches that permits ready assembly by the installer, that may be operably associated with any standard rocker arm type switch, and that is economical of manufacture, convenient to use, and long lived in operation.

In accordance with this invention, a mechanical actuation arrangement is provided for actuating a remotely located power switch which comprises a rocker arm actuated type electrical switch that is mounted in the usual electrical box, and within easy reach of the operator, but which is free of electrical connections. Extending between the box for the electrically isolated switch and the box for the power switch is a drive rod, which is connected to an actuator assembly operably associated with the power switch and arranged to mount the same in its box. The actuator assembly comprises a mounting frame and a swing arm which is forked at one of its ends to receive the rocker arm of the power switch, and is lugged at its other end for operative connection to the drive rod. Appropriate electrical conduiting extends between the two boxes through which the drive rod extends for complete masking of same, it being understood that the drive rod is the only connection between the electrically isolated actuator switch and the power switch being actuated. Actuation of the rocker arm of the electrically isolated actuator switch actuates the rocker arm of the power switch by way of the drive rod.

Other objects, uses, and advantages will be obvious or become apparent from a consideration of the following detailed description and the application drawings.

However, it is to be distinctly understood that the specific drawing illustrations provided are supplied primarily to comply with the requirements of the Patent Laws, and that the invention is susceptible of other embodiments that are intended to be covered by the appended claims.

Figure 1:
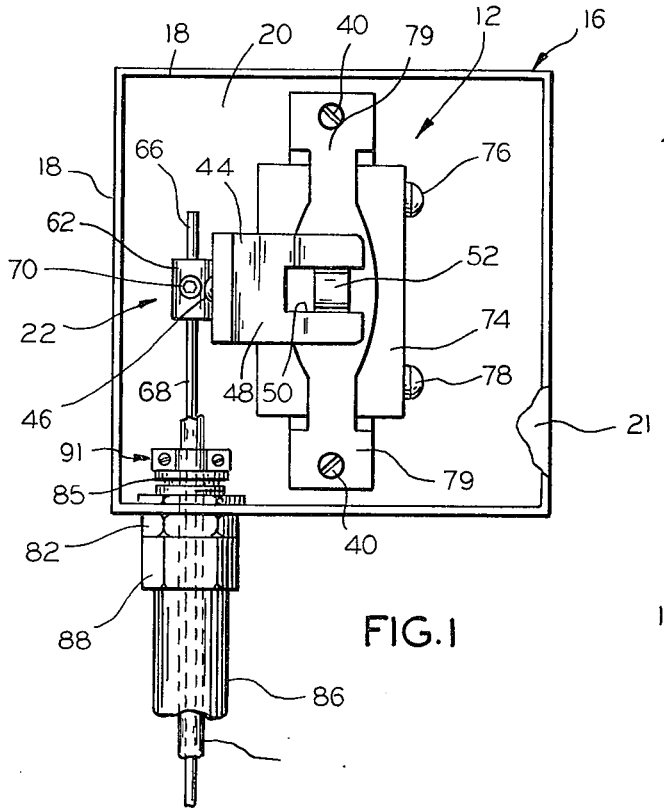
FIG. 1 is a diagrammatic plan view illustrating a preferred embodiment of the invention, with parts being broken away to facilitate illustration.
Figure 1A:
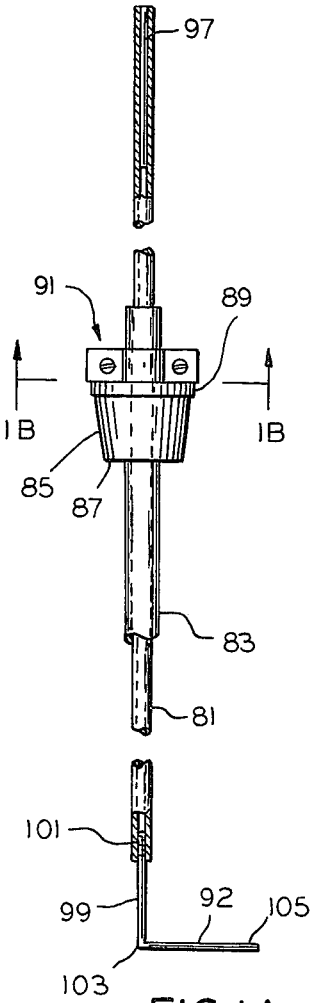
FIG. 1A is a fragmental view illustrating details of construction.
Figure 1B:
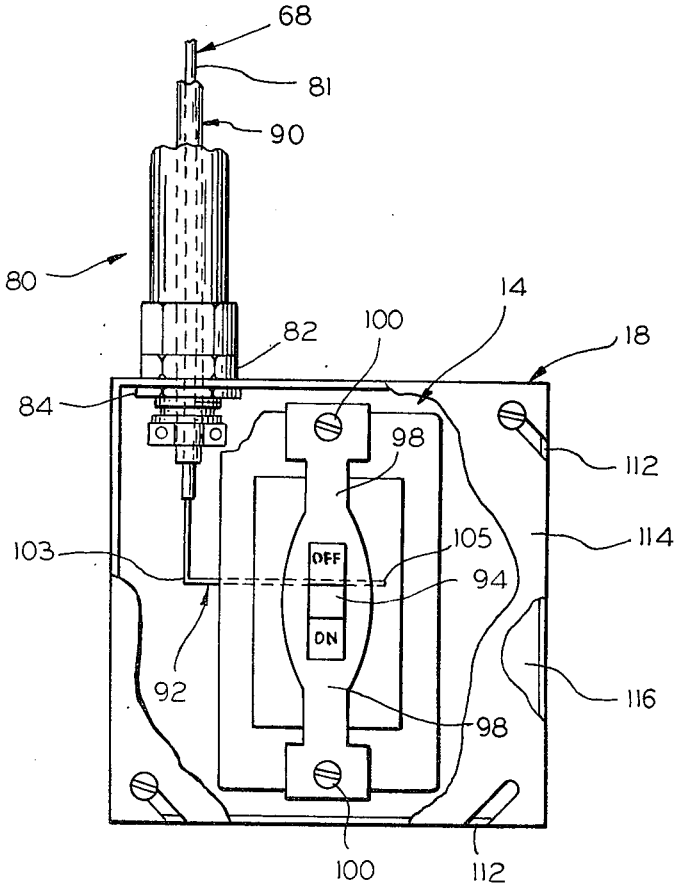
FIG. 1B is a cross-sectional view along line 1B—1B of FIG. 1A.
Figure 1B:
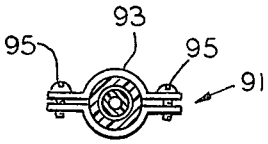

Reference numeral 10 of FIG. 1 generally indicates a preferred embodiment of the invention, whereby power switch 12 that is remotely located, for instance, at the ceiling of a room, is actuated by an electrically isolated switch 14 which is suitably located for convenience of operation by an operator standing on the room floor.

The power switch 12 is mounted in suitable electrical box 16 while the electrically isolated actuator switch 14 is mounted in suitable electrical box 18.

In accordance with this invention, the box 16 can be of any suitable type involving suitable side walls 18 and bottom wall 20 and a suitable cover 21 of a conventional type.

Further in accordance with this invention, the power switch 12 is operably mounted in the box 16 by applying it to actuator assembly 22 (that is mounted within the box 16), which assembly 22 is mechanically connected to electrically isolated switch 14.

The actuator mechanism 22 comprises a generally U-shaped frame 24 (see FIGS. 4 – 6) defining a web 26 and end flanges or legs 28 and 30, with the legs 28 and 30 defining the respective tabs 32 and 34 that are in coplanar relation and extend in opposite directions. The tabs 32 and 34 are formed with suitable openings 36 and 38, respectively, for mounting the power switch 12 between the tabs 32 and 34 using suitable mounting screws 40 (see FIG. 1).

The frame 24 also includes a side flange or leg 42 which is disposed out of the plane of the legs or flanges 28 and 30 (see FIG. 5), but extends parallel to such plane. Leg 42 has pivotally mounted on same swing arm 44 that is suitably connected thereto in the form shown by rivet 46.

Swing arm 44 has its end 48 at right angles to same and slotted as at 50 to define a forked or bifurcated configuration to receive the power switch rocker arm 52 in the close fitting manner indicated in FIG. 1.

The other end 54 of swing arm 44 includes angled portion 56 that diverges from the frame leg 42, which merges into end portion 58 that is disposed in a plane paralleling the leg 42, and has suitably pivotally secured to same, as by employing appropriate mounting screw or other type of fastener 60, suitable lug or connecting block 62 which is formed with opening 64 extending through same to receive one end 66 of drive rod 68 that is connected to the electrically isolated actuator switch 14.

The mounting block or lug 62 has threadedly mounted in same a suitable set screw 70 which may be of the Allen head type that is suitably socketed for receiving a suitable turning tool to turn same against the driving rod end 66 to fix the driving rod relative to the rocker arm 44. Screw 70 is disposed normally of the opening 64 for this purpose.

The frame 24 is formed with suitable openings 72 (see FIG. 4) to receive mounting screws or the like that fix same to the back wall 20 of box 16.

The power switch 12 may be of any conventional type employing the usual switch body 74 equipped with terminals 76 and 78 to which the usual leads are attached, and the rocker arm 52 which operates the switch mechanism involved in the switch 12 that effects "off-on" operation of the switch 12. Switch 12 has the usual mounting arms 79 to which screws 40 are applied to secure the switch 12 in its operative position within box 16.

The drive rod 68 extends from the actuator assembly 22 to box 18 through conduiting assembly 80 which may be of any suitable type, that shown comprising suitable fittings 82 secured to the respective boxes in a knock out opening thereof, as by employing the usual lock nuts 84 and having electrical conduiting 86 connected thereto by employing the usual clamp nut 88. In other words, the conduiting assembly 80 may be constructed of the usual electrical conduiting components (and may be of the rigid or thinwall types), but as clearly shown in the drawings, the conduiting 80 does not receive any electrical leads or connectors. Rather, it receives the drive rod 68 for purposes of masking and guiding same.

The drive rod 68 comprises an elongate tubular member 81 slidably received within tubular guide tube member 83 which extends between the boxes 16 and 18. Members 81 and 83 are formed from a suitable self-lubricating plastic material such as Nylon or Teflon so that drive rod 68 will move freely within guide tube member 83 even though boxes 16 and 18 are a substantial distance apart and curves, corners, and loops may be involved in the shaping of conduiting 86. The guide tube 83 is fixed against movement by being gripped at the respective fittings 82 by a bushing 85, formed from a resiliently compressible material material such as rubber, and having a tapered shank 87 that is press fitted into the throat of fitting 82 to deform the bushing shank 87 into firm engagement with the guide tube 83 at the location of the fittings 82. The bushings 85 each define a flanged end 89 against which is applied a suitable movement stopping device, such as clamp device 91, that holds the guide tube 83 against being drawn into the particular bushing 85 at which the respective clamp devices are applied (on operation of device 10). Device 91 comprises a pair of spaced apart clamping members 93 shaped to be clamped against the guide tube by screws 95. Clamp devices 91 preferably abut the respective bushings 85 in serving as movement preventing stops. Bushings 85 also serve to center the guide tube relative to the respective fittings 82.

The drive rod 68 extends within the box 18, through the knock out opening of same to which the conduiting 80 is applied, to present its end 92 for operative connection to the actuator switch 14. In the form shown, drive rod end 92 comprises rod element 99 that is threaded at its end 101 for threaded application to the bore of tubular member 81 (that forms dry rod 68), with the rod element 99 being angled as at 103 to present its end 105 for application to actuator switch 14.

The stop function served by clamp devices 91 may also be served by employing other familiar forms of tube clamping or gripping devices or elements that will prevent movement of the guide tube relative to the respective boxes 16 and 18.

The acuator switch 14 may be of any suitable type employing rocker arm 94 operatively mounted on a switch body 96, with the switch 14 being provided with the usual mounting arms 98 for securing the switch to the box employing suitable mounting screws 100 in any suitable manner. Though switch 14 is to be inoperative and isolated electrically, a switch of the type indicated serves as a suitable device to effect operation of drive rod 68. In accordance with this invention, a thumb screw 102 is operatively applied to the switch arm 94 for purposes of connecting the drive rod head 92 thereto. Thumb screw 102 includes threaded shank 104 that is suitably threaded in the body 106 of the switch arm 94 to present the flat body portion 108 of same exteriorly of the switch body 96, extending oppositely of the switch arm 94. The switch body 96 is appropriately formed to accommodate the necessary rocking motion of the thumb screw 102, the thumb screw 102 being suitably apertured at 110 to receive the end 92 of drive rod 68 (and specifically, the end 105 of rod element 99), which, as indicated in FIG. 1, is disposed at right angles to the drive rod 68 for this purpose.

The box 18 may be of any suitable type including side walls 112, suitable cover 114, and back wall 116, with switch 14 being suitably mounted on box 18, as by employing screws 110, to space switch 14 sufficiently from the box back wall to provide the needed working space for thumb screw 102.

The boxes 16 and 18 are mounted in the usual manner, and the arrangement of this invention is such that the box 16 can be positioned near a room ceiling to meet electrical code requirements governing high voltage switching, while the box 18 is positioned adjacent floor level for convenient operation by an operator who may be a member of the public that is protected by the electrical code.

The rocker arm 94 of switch 14 swings about pivot axis 120, as is conventional for devices of this type; the rocker arm 52 of switch 12 is similarly arranged.

When it is desired to actuate the power switch 12, the operator swings the rocker arm 94 of switch 14 in the appropriate direction, which movement is directly transmitted by the drive rod 68 to the swing arm 44 and rocker arm 52 of the switch 12. In the form shown, the off position of switch 12 is achieved with a downward inclined position of rocker arm 94, while the on position of switch 12 is achieved by an upwardly inclined position of rocker arm 94.

The connection that the drive rod 68 makes with the pivotal connection block 62 is adjustable to accommodate conditions with the drive rod end 66 fitting within the opening 64 in free sliding relation thereto. Setting of the set screw 70 against the drive rod end 66, and specifically, against dowel pin 97, fixes the swing arm 44 for mechanical actuation by the drive rod 68. The block 62 pivots relative to swing arm 44 on operation of the device to avoid undue bending of the drive rod end 66.

The remotely located switch 12, in addition to being located in an overhead position, can be located below the floor level of the location of the actuating switch 14, or to one side or the other of the switch 14, with the conduiting 80 being appropriately shaped to accommodate the positioning of the power switch relative to the actuator switch. The guide tube 83, which is held against movement longitudinally thereof by the action of the bushings 85 and clamp devices 91 at the box fittings 82, and the drive rod when mounted in operating position, conform themselves to the general shape of the conduiting 86 and any connectors (not shown) involved in same, for smooth and free sliding action of the drive rod 68 in either direction.

Figure 6:
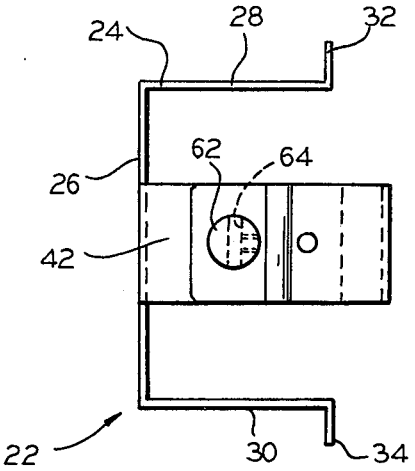
FIG. 6 is a side elevational view of the actuator assembly shown in FIG. 4, taken substantially along the line 6—6 of FIG. 4.
Figure 4:
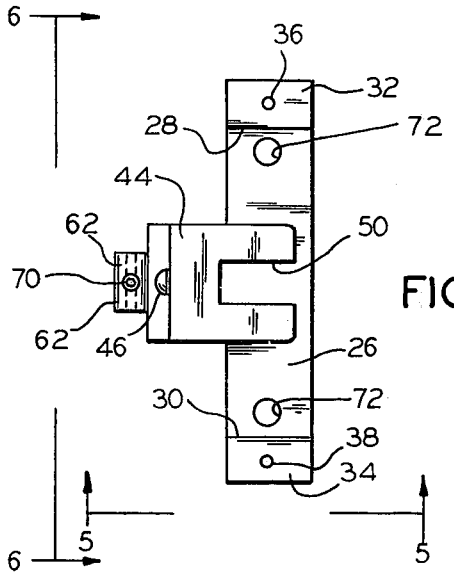
FIG. 4 is a plan view of the actuator assembly for the power switch.
Figure 5:
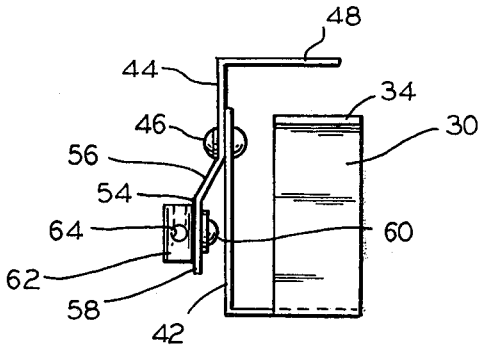
FIG. 5 is an end elevational view of the assembly shown in FIG. 4, taken substantially along line 5—5 of FIG. 4.
Figure 3:
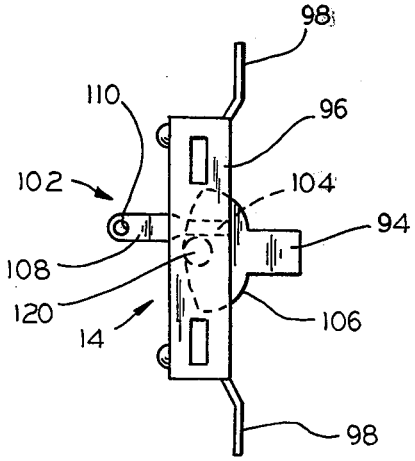
FIG. 3 is a side elevational view of the switch mechanism shown in FIG. 2, taken substantially along line 3—3 of FIG. 2.
Figure 2:
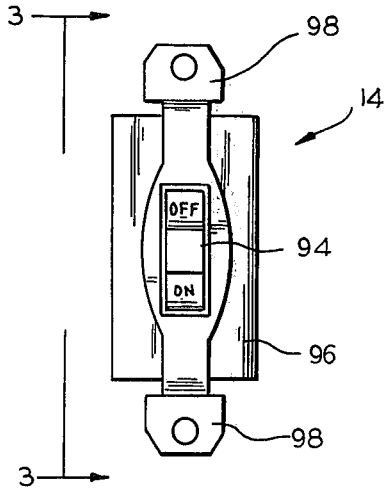
FIG. 2 is an elevational view of the electrically isolated switch that is employed to actuate the power switch.
Figure 7:
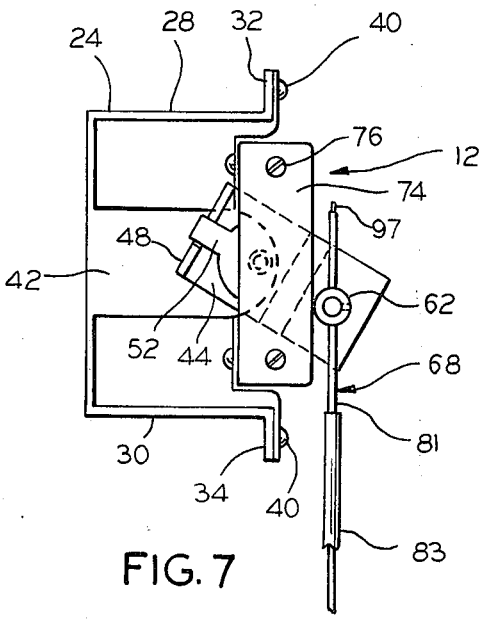
FIG. 7 is a view similar to that of FIG. 6 illustrating a modified arrangement.

In the showing of FIG. 7, the swing arm 44 of actuator assembly 22 is applied to the flange 42 of frame 24 inverted from the position of FIGS. 4 – 6, and on the inside of flange 42, so that the power switch 12 can be disposed on top of swing arm end 48 for engagement with the switch rocker arm 52. This avoids having to slip the switch 12 under the swing arm end 48 to secure the switch to the mounting tabs 32 and 34 of frame 24.

Figure 8:
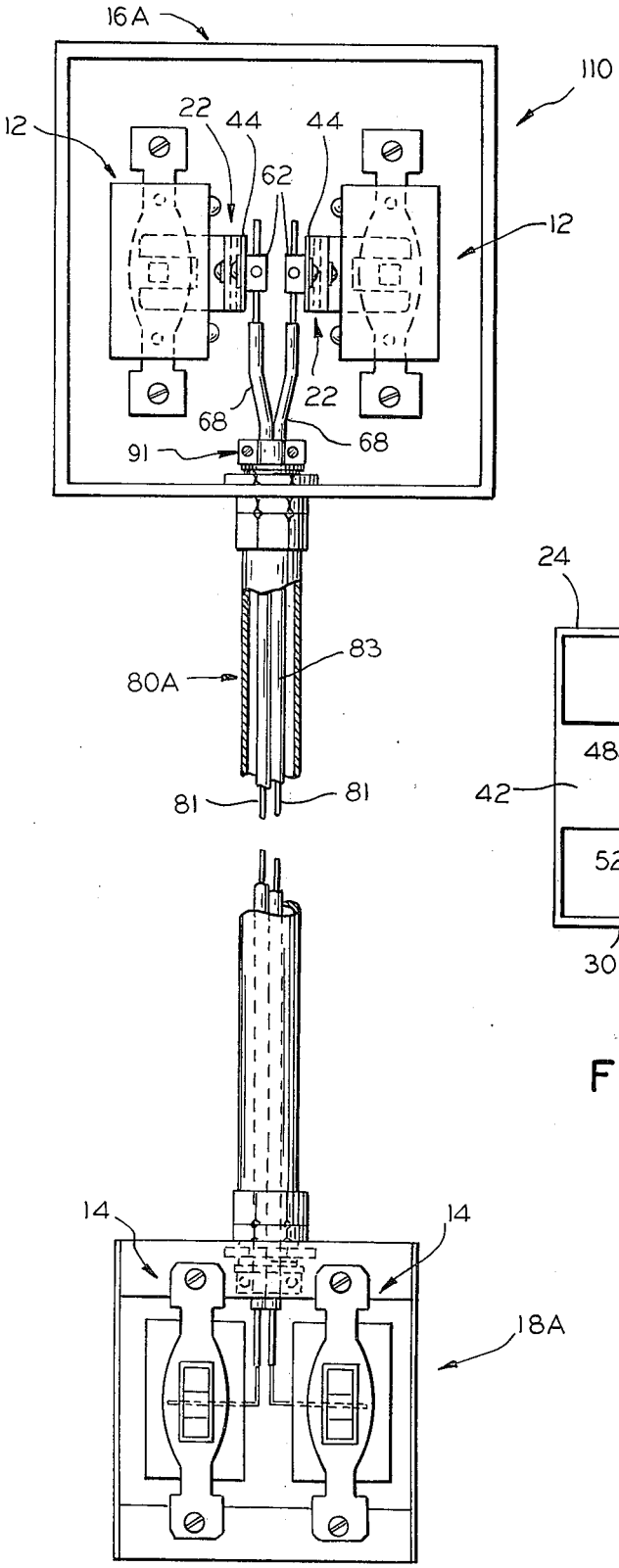
FIG. 8 is a view similar to that of FIG. 1, illustrating a dual switch installation in accordance with the invention.

In the showing of FIG. 8, a dual switch arrangement 110 is illustrated in which a pair of power switches 12 are applied to box 16A, by being respectively applied to the respective actuator mechanisms 22, each arranged as shown in FIG. 7 (and mounted in the box 16A as indicated in FIGS. 1 and 4 – 6) for actuation by the respective electrically isolated switches 14 that are suitably applied to the floor operated box 18A (as in the manner shown in FIGS. 1 – 6). In this embodiment, the drive rods 68 that are involved are applied to a single conduiting assembly 80A, with the bushings 85 and clamp devices 91 accommodating both guide tubes 83 that are involved. The reference numerals common to FIGS. 1 – 7 indicate like parts (boxes 16A and 18A are only diagrammatically illustrated.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. In an arrangement for shifting an off-on electrical switch, between off and on positions, that is remote from the operator, in which arrangement the switch is mounted in a fixedly mounted switch box and includes a rocker arm for shifting the switch between its said positions, an electrically insulated actuator mechanism for actuation by the operator, which actuator mechanism is located remotely from said box, and drive rod means extending between said box and said actuator mechanism and operatively connected between said switch rocker arm and said mechanism for effecting shifting of said switch between its said positions utilizing said actuator mechanism, the improvement wherein:

said actuator mechanism is mounted in an electrically isolated box and includes a rocker arm adapted to be hand operated by the operator.

electrical conduiting extending between said boxes, said conduiting having one of its ends connected to said switch box and the other of its ends connected to said isolated box, said conduiting ends being connected to the respective boxes by electrical fitting means each including a tubular body extending into the respective boxes and means for making the respective bodies fast to their respective boxes, said drive rod means comprising:

a guide tube extending between said boxes and through said conduiting and said bodies of the respective fitting means, each of said fitting means bodies having a compressible bushing press fitted therein into compressed gripping relation with said guide tube, stop means carried by said guide tube for maintaining the respective bushings in said gripping relation with said guide tube, and a drive rod extending through said guide tube and having one of its ends operably connected to said switch rocker arm and the other of its ends operably connected to said actuator mechanism rocker arm, said guide tube and said drive rod being formed from materials of self lubricating characteristics and being resiliently flexible laterally thereof whereby said conduiting may be shaped in diverse configurations between said boxes and said guide tube may be housed within said conduiting in substantial conformity to the configuration of said conduiting longitudinally thereof, said electrical conduiting being free of electrical wiring extending therethrough, said means for maintaining the respective bushings in their said gripping relations with said guide tube comprising clamp devices fixed to said guide tube within the respective boxes and substantially abutting the respective bushings, said bushings being jam fitted in their respective fitting means bodies to resist movement exteriorly of the respective boxes.

2. The improvement set forth in claim 1 including:

a switch mounting and actuator assembly mounted in said switch box, said assembly comprising:

a U-member defining a web, and end flanges projecting normally thereof in substantially parallel relation, said U-member end flanges defining coplanar tabs extending normally of said end flanges, means for operably mounted the off-on switch on said tabs, said U-member defining a mounting arm disposed normally of said web and projecting parallel to the plane of said end flanges, said mounting arm being positioned to one side of the plane of said end flanges, and a swing arm journaled intermediate its ends on said mounting arm, said swing arm having a forked end operably receiving the off-on switch rocker arm and a lugged end having said drive rod connected thereto, said swing arm lugged end having a lug pivotally connected thereto, said lug being bored to receive said drive rod, and means for making said drive rod fast to said lug.

3. The improvement set forth in claim 2 wherein:

said means for making said drive rod fast to said lug comprises a set screw threadedly mounted in said lug for threading into clamping engagement with said drive rod, said drive rod being tubular and having a dowel received in the portion of same that is received in said lug against which said set screw acts.

4. The improvement set forth in claim 3 wherein:

said drive rod in said electrically insulated box has a solid rod element made fast to said drive rod and keyed to said actuator mechanism rocker arm.

* * * * *